US006349547B1

(12) United States Patent
Miller et al.

(10) Patent No.: US 6,349,547 B1
(45) Date of Patent: Feb. 26, 2002

(54) METHOD AND APPARATUS FOR FREEZING PRODUCTS

(75) Inventors: Jeremy Paul Miller, Mortimer; Mark Sherman Williams, Winchester, both of (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/604,873

(22) Filed: Jun. 28, 2000

(30) Foreign Application Priority Data

Jul. 15, 1999 (GB) ..... 9916487

(51) Int. Cl.[7] ..... F25D 13/06; F25D 9/00; F25B 9/00

(52) U.S. Cl. ..... 62/63; 62/87; 62/402

(58) Field of Search ..... 62/63, 87, 402, 62/332, 333, 380

(56) References Cited

U.S. PATENT DOCUMENTS 3,121,999 A * 2/1964 Kasbohm et al. ..... 62/87
3,531,946 A * 10/1970 Hart ..... 62/332
3,611,745 A * 10/1971 Schlemmer ..... 62/333
3,705,500 A * 12/1972 Jehle ..... 62/223
3,714,793 A * 2/1973 Eigenbrod ..... 62/62
3,992,891 A * 11/1976 Pocrnja ..... 62/87
4,711,093 A * 12/1987 Markbreiter et al. ..... 62/87
5,410,886 A * 5/1995 Wallace et al. ..... 62/63
5,694,776 A * 12/1997 Sahm ..... 62/63

FOREIGN PATENT DOCUMENTS

GB 2275098 A * 2/1994
GB 2275098 8/1994 ..... F25D/3/10

* cited by examiner

*Primary Examiner*—William C. Doerrler
(74) *Attorney, Agent, or Firm*—Robert J. Wolff

(57) ABSTRACT

A method of freezing a product, which method comprises the steps of vaporizing a cryogenic liquid and warming the vapor thus formed in indirect heat exchange with a product to be frozen, work expanding the warmed vapor, and using the work expanded vapor thus obtained to refrigerate the or another product.

37 Claims, 12 Drawing Sheets

METHOD AND APPARATUS FOR FREEZING PRODUCTS

FIELD OF THE INVENTION

This invention relates to a method and apparatus for freezing products and, more particularly but not exclusively, is concerned with a method and apparatus for freezing foodstuffs.

BACKGROUND OF THE INVENTION

The use of liquid nitrogen to freeze foodstuffs has increased dramatically over the past 30 years. The improvement in the quality of the frozen food is well known. However, whilst liquid nitrogen is now used for freezing premium food products its cost prevents it being used for freezing those foodstuffs which do not command a premium price. These foodstuffs are typically frozen using mechanical refrigeration.

Over the years many attempts have been made to reduce the quantity of liquid nitrogen required to freeze a given foodstuff and gradually it has become economically viable to use liquid nitrogen to freeze an increasing range of foodstuffs.

The present invention aims to continue this trend.

SUMMARY OF THE INVENTION

According to the present invention there is provided a method of freezing a product, which method comprises the steps of vaporising a cryogenic liquid and warming the vapour thus formed in indirect heat exchange with a product to be frozen, work expanding the warmed vapour, and using the work expanded vapour thus obtained to refrigerate the or another product.

Whilst the cryogenic liquid will usually be liquid nitrogen, it could also comprise another cryogenic liquid, for example liquid air.

If desired, the work expanded vapour may be brought into direct heat exchange with said product to refrigerate the same. Alternatively, the work expanded vapour may be brought into indirect heat exchange with said product to refrigerate the same.

Advantageously, said method includes the step of using the work recovered during said work expansion to heat water.

Alternatively, or in addition, said method may include the step of using the energy recovered during said work expansion to drive a turbulence inducing fan.

Alternatively or in addition, said method may include the step of using at least part of the work recovered during said work expansion to at least partially power a mechanical refrigerator having a refrigerated space.

In one embodiment, said method includes the step of passing said product through said refrigerated space after freezing it with cryogenic fluid.

In another embodiment, said method includes the step of passing said product through said refrigerated space before freezing it with cryogenic fluid.

Advantageously, said cryogenic liquid is liquid nitrogen and said method includes the step of supplying liquid nitrogen at a pressure greater than 5 bar g, preferably greater than 10 bar g, more preferably greater than 15 bar g, and advantageously less than 20 bar g.

Preferably, said product is a foodstuff.

The present invention also provides an apparatus for freezing a product, which apparatus comprises a freezer, a heat exchanger in said freezer, and a work expander, the arrangement being such that, in use, cryogenic liquid can be vaporised and warmed in said heat exchanger, the vapour thus formed expanded in said work expander, and then used to further refrigerate product in said freezer.

Advantageously, said apparatus further comprises a second heat exchanger for conveying expanded vapour from said work expander through said freezer in indirect heat exchange with said product.

Preferably, said apparatus includes means to transfer energy from said work expander to water.

Advantageously, said work expander is connected to a fan for inducing turbulence in said freezer.

Preferably, said apparatus includes a mechanical refrigerator having a compressor associated therewith, and means for, in use, transferring energy from said work expander to said compressor.

In one embodiment, said work expander may be directly coupled to said compressor.

In another embodiment said work expander is connected to a generator, said compressor is connected to a motor, and said generator is connected to said motor.

Preferably, said apparatus includes a power control unit, wherein said generator is connected to said motor via said power control unit.

Advantageously, said power control unit is connectable to mains power and is capable, in use, of directing energy from said mains power to said motor as required.

Preferably, said mechanical refrigerator includes a heat exchanger arranged to cool compressed refrigerant from said compressor in heat exchange with said expanded vapour from said freezer.

Advantageously, said mechanical refrigerator comprises a refrigerated space.

In one embodiment, said refrigerated space is disposed downstream of said freezer.

In another embodiment, said refrigerated space is disposed upstream of said freezer.

In a further embodiment there are two refrigerated spaces (which may be associated with a single mechanical refrigerator or separate and distinct mechanical refrigerators) one of which is disposed upstream of said freezer and the other of which is disposed downstream thereof.

Preferably, said apparatus further comprises a pump to raise the pressure of said cryogenic liquid prior to entering said heat exchanger.

Advantageously, said pump is capable of delivering liquid nitrogen at a pressure of at least 10 bar g.

For a better understanding of the present invention reference will now be made, by way of example, to the accompanying drawings, in which:

DETAILED DESCRIPTION OF THE PREFERRED EMBODIMENTS

Figure 1:
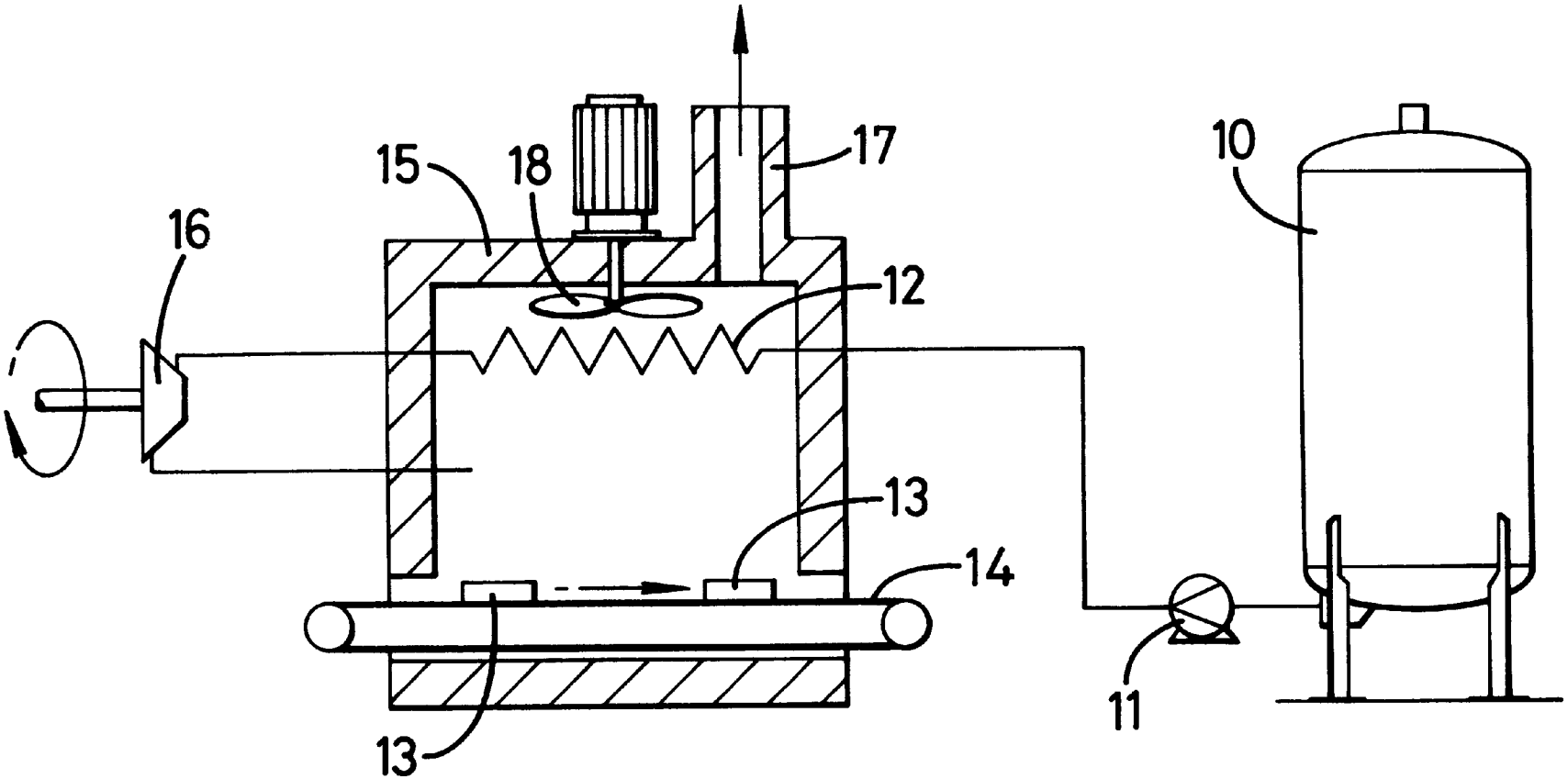
FIG. 1 is a schematic side elevation, partly in cross-section, of one embodiment of an apparatus according to the present invention.

Referring to FIG. 1 there is shown a cryogenic storage vessel which is generally identified by reference numeral 10.

A pump 11 is arranged to take liquid nitrogen at minus 196° C. from the cryogenic storage vessel 10 and pump it to about 14 bar g.

The liquid nitrogen is then passed through a heat exchanger 12 where it evaporates and refrigerates food 13 being transported on a conveyor 14 through a freezing tunnel 15.

The nitrogen vapour leaves the heat exchanger 12 at about =40° C. and is then work expanded through a work expander 16 to atmospheric pressure. The cold nitrogen vapour which leaves the work expander is introduced into the freezing tunnel 15 in direct heat exchange with the food 13.

The nitrogen leaves the freezing tunnel 15 through exhaust duct 17 and is vented to atmosphere. A turbulence inducing fan 18 is provided to improve heat transfer between the nitrogen vapour in the freezing tunnel 15 and the food 13 in the usual manner.

Calculations indicate that the freezing tunnel should use nearly 25% less liquid nitrogen than a conventional tunnel freezer in which the liquid nitrogen is supplied directly from the cryogenic storage vessel and is introduced at about 1 bar g into the freezing tunnel via conventional nozzles.

In addition to the above saving two further savings will be noted. In particular, the energy available at the work expander 16 can be recovered and used for an ancillary purpose, for example for heating the large quantities of water which are required to clean the freezing tunnel at regular intervals. In addition it will be noted that the pump 11 obviates the need for the usual evaporator arrangement used for dispensing the liquid nitrogen. In particular, in conventional arrangements a small portion of the liquid nitrogen from a cryogenic storage vessel is withdrawn and evaporated. The vapour, typically at a pressure of up to 3.5 bar a (2.5 bar g) is then introduced into the top of the cryogenic storage vessel where it pressurises the cryogenic storage vessel 10. The use of pump 11 eliminates the need for a vaporiser and achieves a significant additional saving of liquid nitrogen.

The pressure of the liquid from the storage vessel 10 is preferably raised with as little increase in enthalpy as possible. The use of a pump to pump the liquid nitrogen to the desired pressure is particularly recommended. It is conceivable that the pressure could be raised by the use of the evaporator associated with a conventional storage vessel. However, the use of such an arrangement would almost certainly result in an unacceptable increase in enthalpy which would significantly reduce, or even negate, the saving envisaged. It is also conceivable that the pressure could be raised by pressurising the liquid nitrogen in the storage vessel with pressurised helium. However, this would appear expensive and impractical.

The pressure to which the liquid nitrogen should be raised affects the savings which can be achieved.

Figure 2:
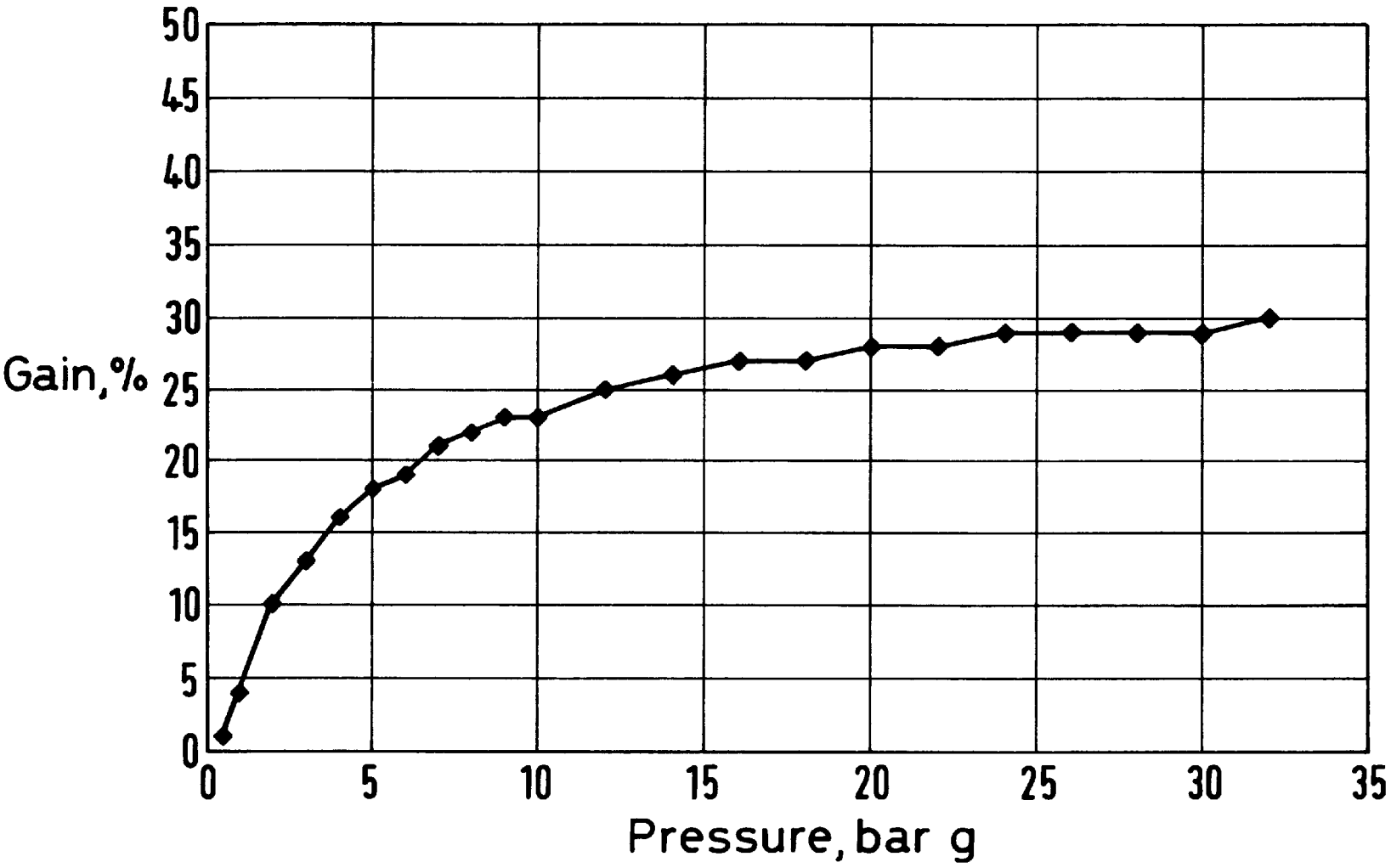
FIG. 2 is a graph showing the saving in the amount of liquid nitrogen used for a given task plotted against the pressure to which the liquid nitrogen is pumped.

As shown in FIG. 2 the savings increase rapidly as the pressure is increased from 1 to 10 bar g. However, the rate of improvement decreases rapidly thereafter. It will be seen that a 10% saving can be achieved at a pressure of about 2.5 bar g and about 18% at 10 bar g. However, the more significant savings are achieved above 13 bar g. As can be seen from FIG. 2 the incremental improvement above 20 bar g is very small and there would appear to be little point in operating above this pressure.

It should be noted that the curve shown in FIG. 2 assumes a work expander efficiency of 88%. However, consideration of work expanders with higher efficiencies shows a similar curve to that shown in FIG. 2 and the useful operating pressures are in the same range as those shown in FIG. 2.

Various modifications to the embodiments described are envisaged, for example the indirect heat exchanger could be used to cool the foodstuff in a separate chamber upstream or downstream of the freezing tunnel 15. Alternatively, the indirect heat exchanger could be used to cool foodstuff in or associated with a separate and distinct food processing line in a factory having several food processing lines.

Figure 3:
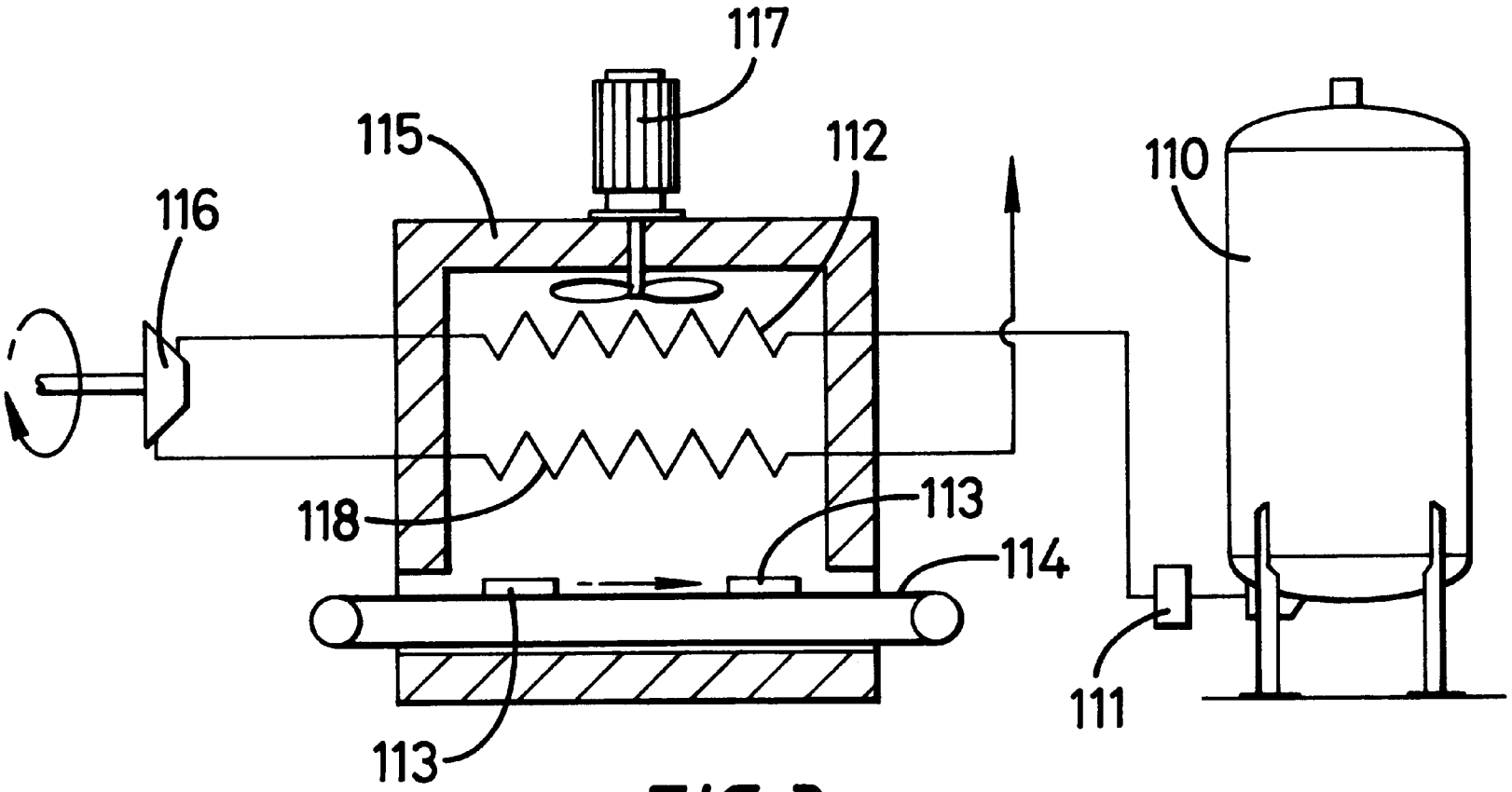
FIG. 3 is a schematic side elevation, partly in cross-section, of a second embodiment of an apparatus according to the present invention.

In the alternative embodiment shown in FIG. 3 parts having a similar function to parts shown in FIG. 1 have been given similar reference numerals but in the '100' series. It will be note that the main differences are that the centrifugal pump 11 has been replaced by a reciprocating pump 111 and that the expanded nitrogen vapour is passed through an indirect heat exchanger 118 in the tunnel freezer 115 before being vented to atmosphere. This arrangement ensures that no nitrogen vapour enters the workplace.

Figure 4:
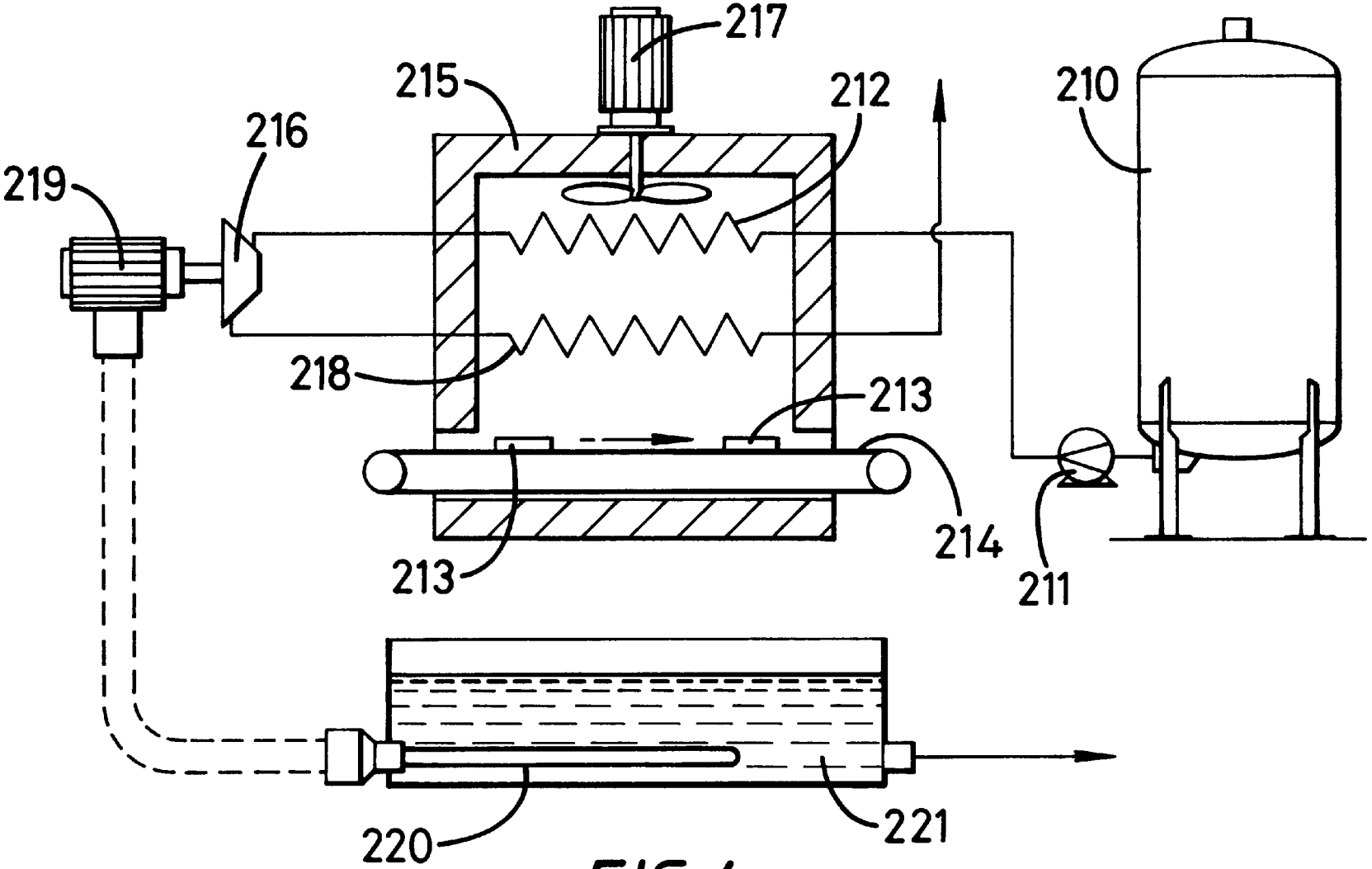
FIG. 4 is a schematic side elevation, partly in cross-section, of a third embodiment of an apparatus according to the present invention.

The embodiment shown in FIG. 4 is generally similar to that shown in FIG. 3 and parts having similar functions have been identified by similar reference numerals in the '200' series. The only significant difference is that the work expander 216 is used to drive an alternator 219 which is connected to an electric heating element 220 which is used to heat water 221 for the routine cleaning of the apparatus. If desired the alternator 219 could simply be replaced by any suitable energy absorbing device, for example a friction brake arrangement arranged to heat the water 221 directly. If desired, the work expander 216 could be used to drive a compressor which could be used to compress, and thereby heat, a gas such as air which could be used to heat the water 221. A directly coupled device known as a "compander" (combined compressor and work expander) can advantageously be used for this purpose.

Figure 5:
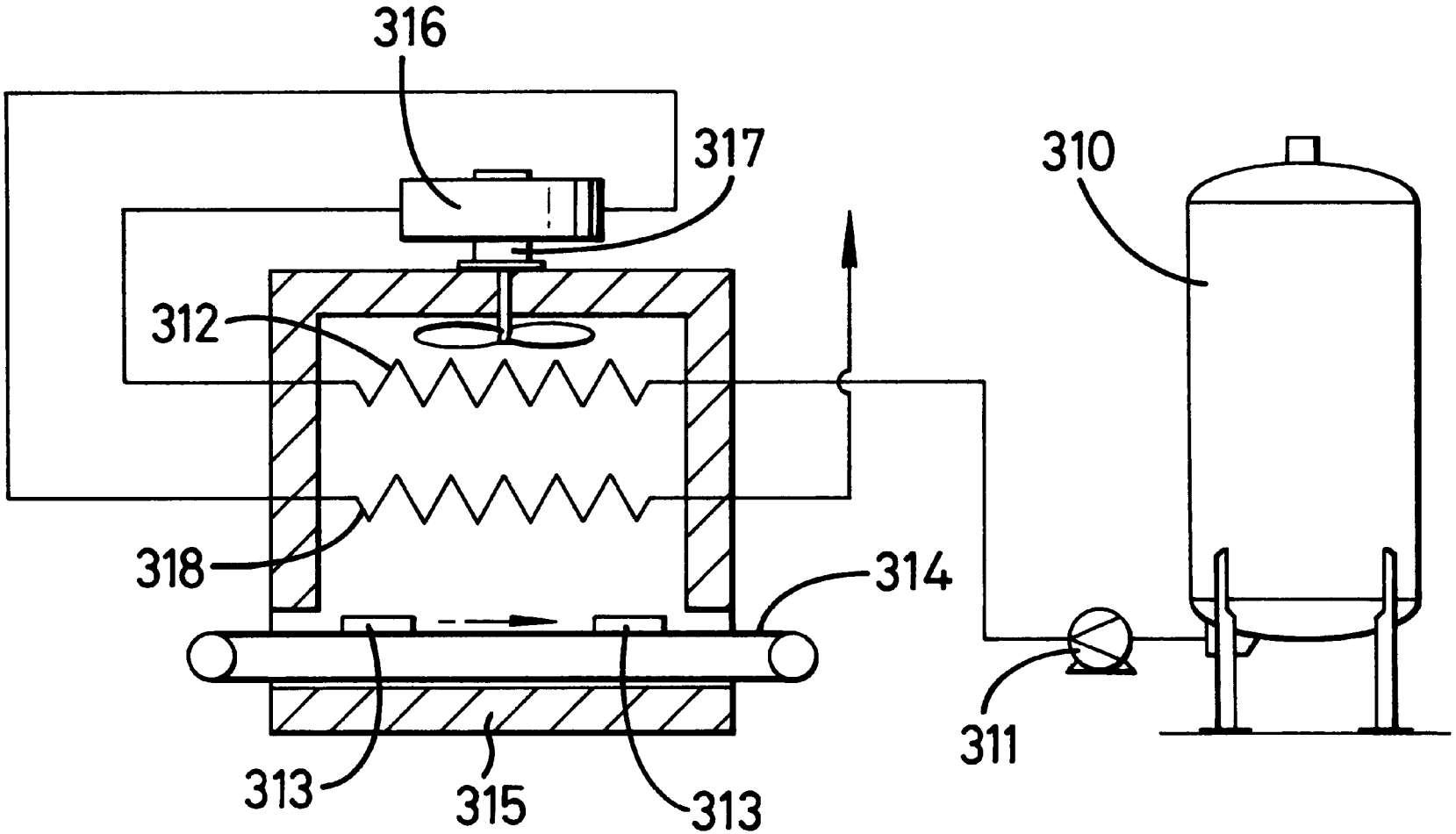
FIG. 5 is a schematic side elevation, partly in cross-section, of a fourth embodiment of an apparatus according to the present invention.

In the embodiment shown in FIG. 5 the energy from the work expander 316 is used to drive the turbulence inducing fan 317. If desired only part of the energy available may be used to drive the turbulence inducing fan 317. It should be appreciated that part of the energy consumed by the turbulence inducing fan 317 will be returned to the inside of the frezing tunnel. However, the same amount of energy would be transferred by a motor driven turbulence inducing fan similar to fan 117.

Figure 6:
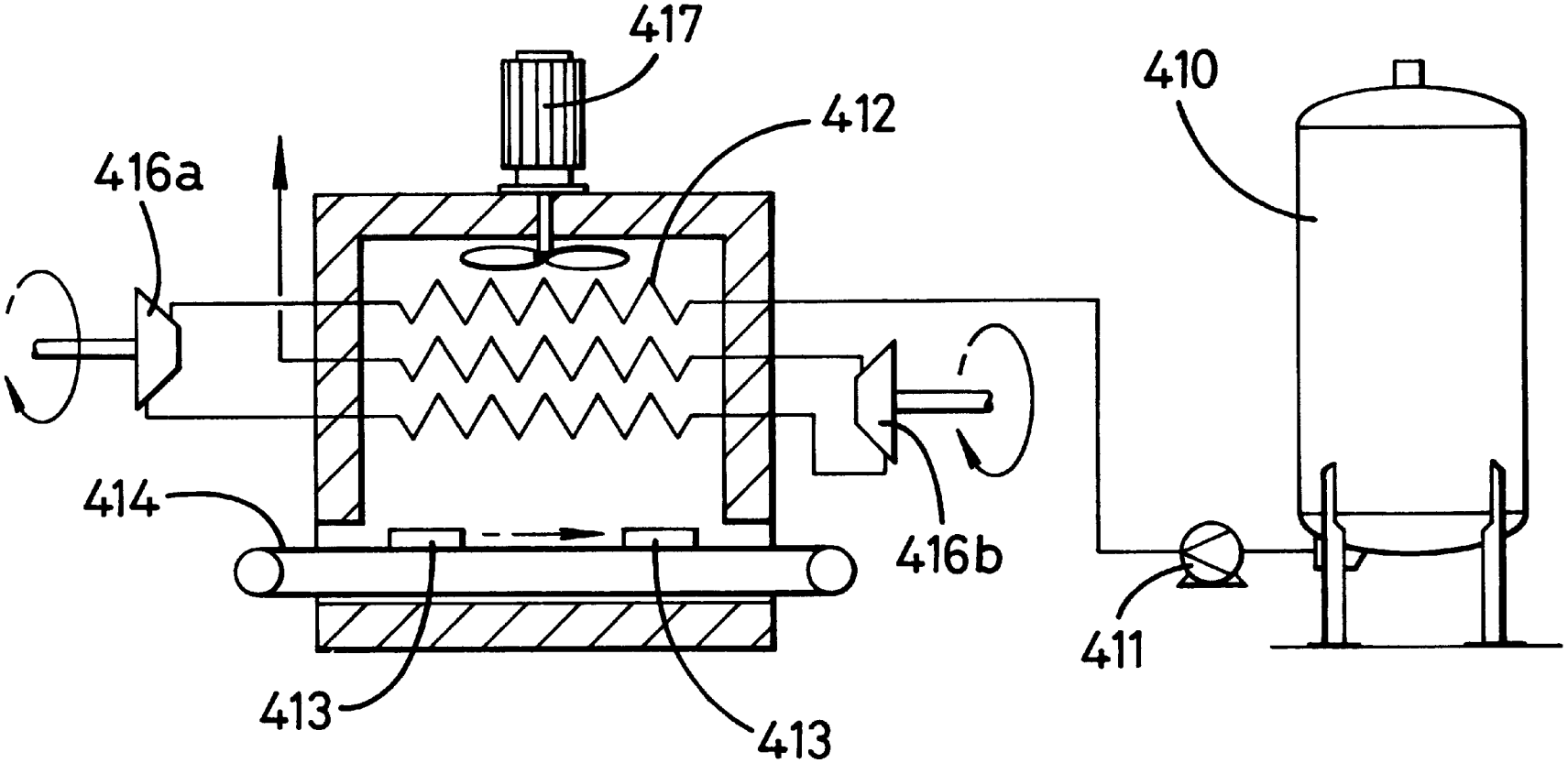
FIG. 6 is a schematic side elevation, partly in cross-section, of a fifth embodiment of an apparatus according to the present invention.

In the embodiment shown in FIG. 6 the warm nitrogen vapour leaving heat exchanger 412 is expanded in two stage via a work expander 416*a* and a work expander 416*b*. It is not presently anticipated that the use of two work expanders connected in series will be necessary although this may have to be considered where the pump 411 pumps the liquid nitrogen to a relatively high pressure.

Figure 7:
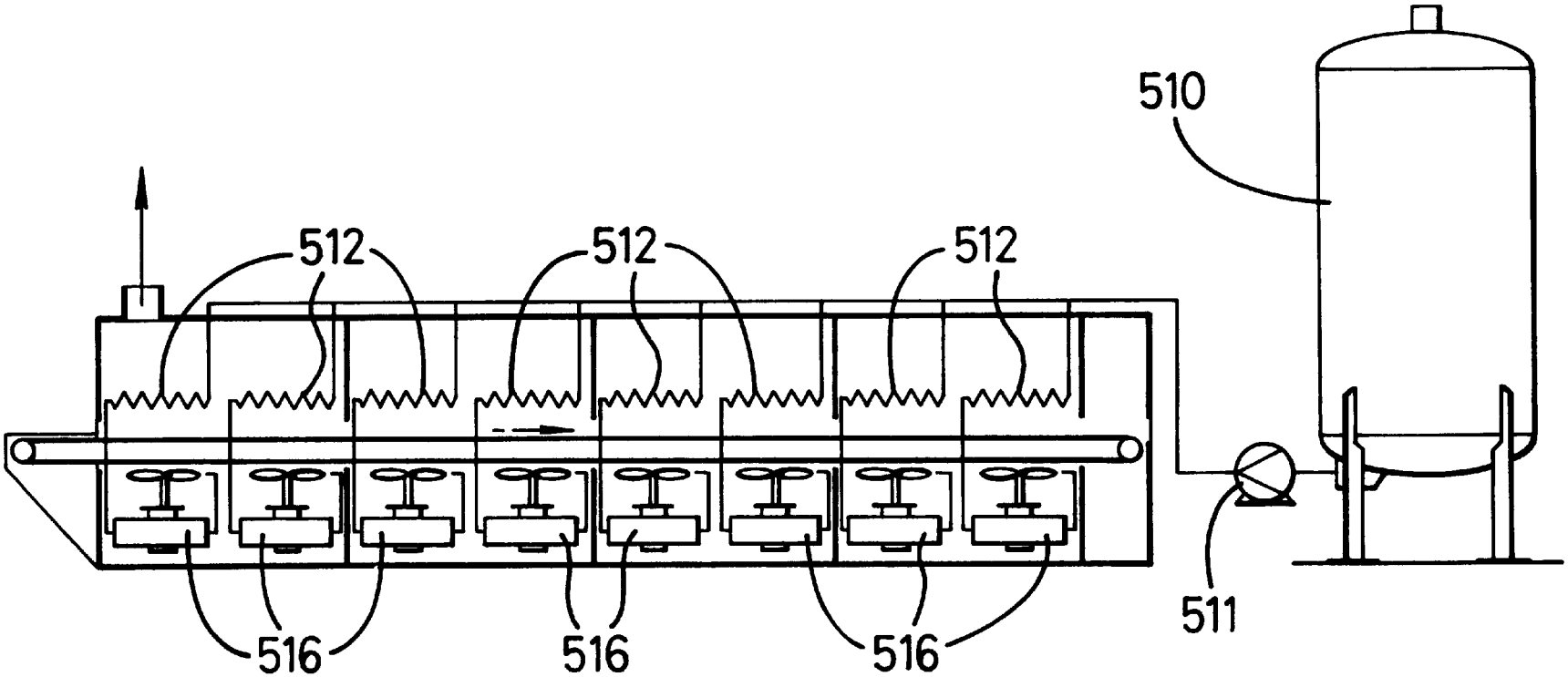
FIG. 7 is a schematic side elevation, partly in cross-section, of a sixth embodiment of an apparatus according to the present invention.

In the embodiment shown in FIG. 7 the liquid nitrogen from pump 511 is passed through a common header to eight separate heat exchangers 512 connected in parallel. The warm vapour at −4020 C. leaving each heat exchanger 512 is expanded through a respective work expander 516 connected to a respective turbulence inducing fan 516. The cold vapour leaving each turbulence inducing fan 516 is introduced directly into the freezing tunnel in the immediate vicinity of a turbulence inducing fan.

Figure 8:
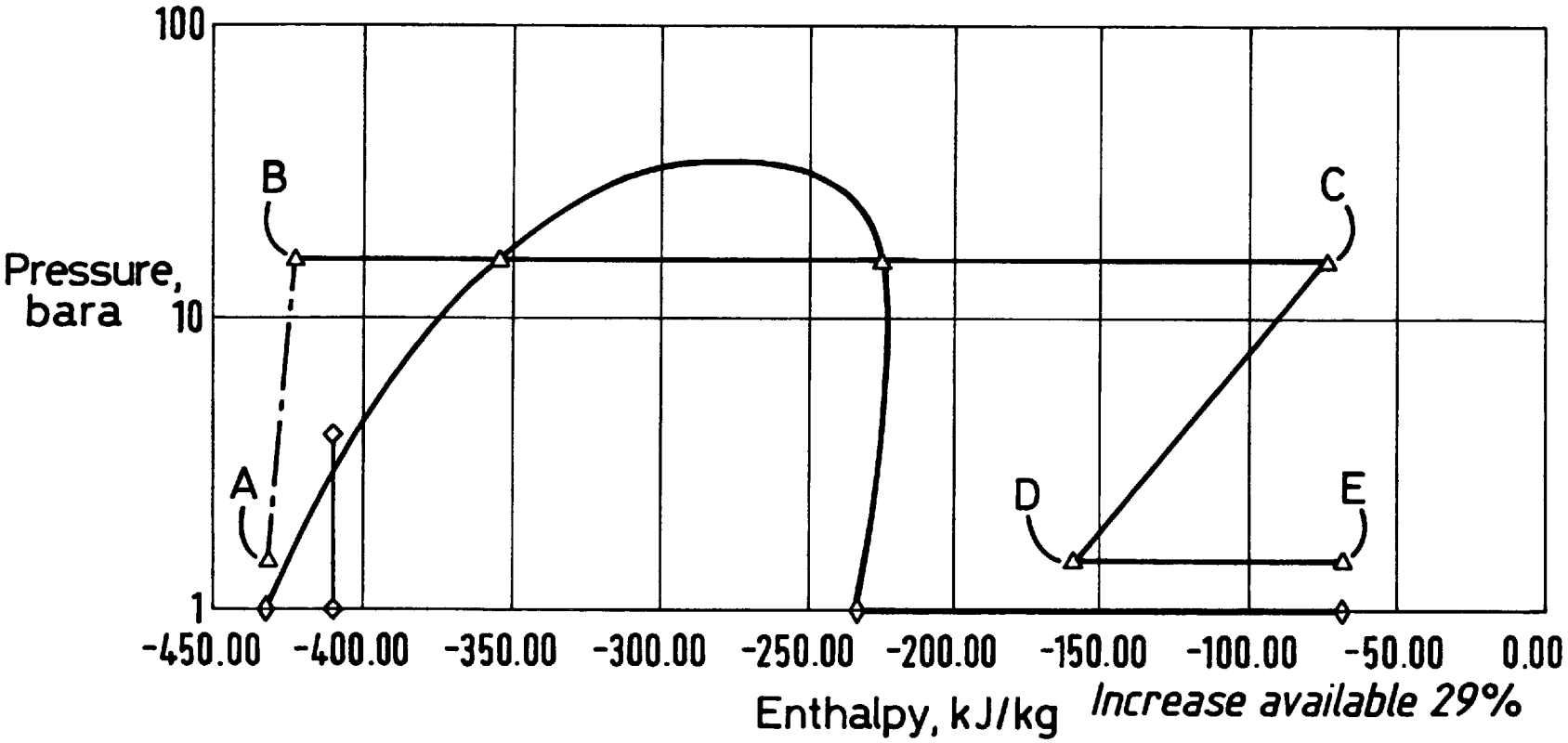
FIG. 8 is a pressure enthalpy diagram associated with the operation of the apparatus shown in FIG. 1.

FIG. 8 shows a simplified pressure-enthalpy diagram associated with the apparatus shown in FIG. 1. As can be seen the pump 11 raises the pressure of the liquid nitrogen substantially isentropically from point A to point B. The liquid nitrogen is then evaporated and warmed and enters the work expander 116 at point C. The work expansion occurs along line CD. Further refrigeration is available from point D to point E. In contrast, in a conventional liquid nitrogen freezer the operating line travels directly from point A to point E.

It will be appreciated from the above discussion that the work expansion may be carried out through a rotary or a reciprocating machine and that the benefit (if any) of expansion though a Joule Thompson (J-T) valve would be negligible.

Whilst the present invention is particularly directed to the use of liquid nitrogen it is also applicable to liquid air. Interestingly, the savings obtained are marginally less than those obtained from liquid nitrogen although the preferred pressure ranges are substantially the same. Refrigeration processing using liquid oxygen, liquid argon, liquid methane and liquid carbon monoxide might also benefit from the present invention. However, there would appear to be little or no advantage in using liquid carbon dioxide in the present invention in the context of food freezing.

The present invention is applicable to both batch and continuous freezers although it is envisaged that it will be particular attractive to continuous freezers, particularly those used for freezing foodstuffs.

Figure 9:
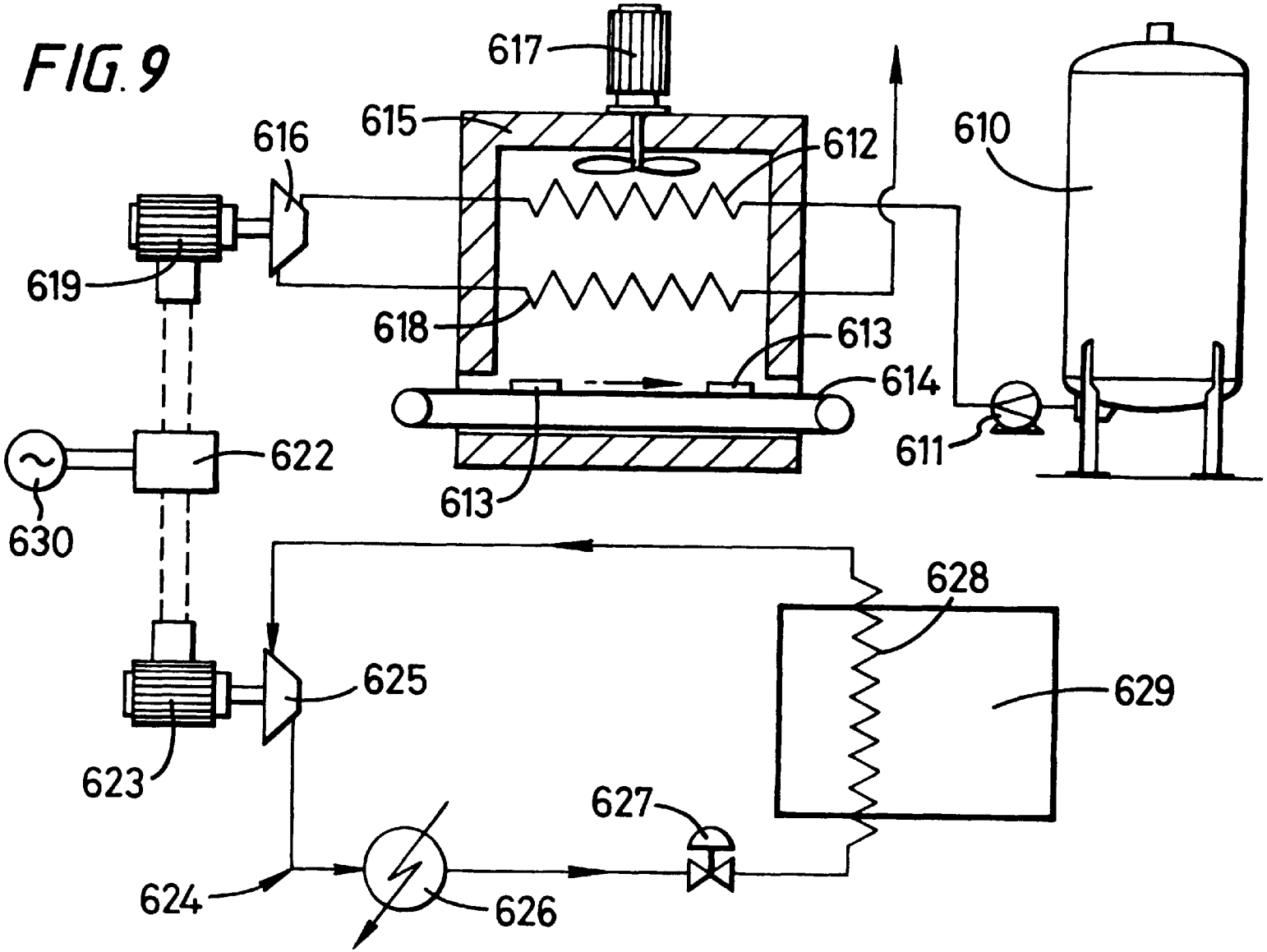
FIG. 9 is a schematic side elevation, partly in cross-section, of a seventh embodiment of an apparatus in accordance with the present invention.

The embodiment shown in FIG. 9 is generally similar to that shown in FIGS. 4 and parts having similar functions have been identified by similar reference numerals in the '600' series. The significant difference is that the alternator 619 is connected to a power control unit 622 which is connected to the motor 623 of a mechanical refrigeration unit which is generally identified by reference numeral 624.

The mechanical refrigeration unit 624 comprises a compressor 625, a heat exchanger 626, an expansion value 627 and a refrigeration coil 628 in a refrigerated space 629.

In use, power generated by the alternator 619 is directed to the motor 623 via the power control unit 622. The motor 623 drives the compressor 625 which compresses a suitable refrigerant, for example ammonia, R22, R134A and methane. The hot refrigerant leaving the compressor 625 is cooled by heat exchange with water in heat exchanger 626. The cooled refrigerant is then expanded through valve 627. The cold refrigerant is then passed through the refrigeration coil 628 in the refrigerated space 629. The refrigerant leaves the refrigerated space and is returned to the inlet of the compressor 625. Because the power available from the alternator 619 may vary, the power control unit 622 is connected to the mains 630 and is arranged to draw any power which may not be available from the alternator 619 from the mains 630.

Figure 10:
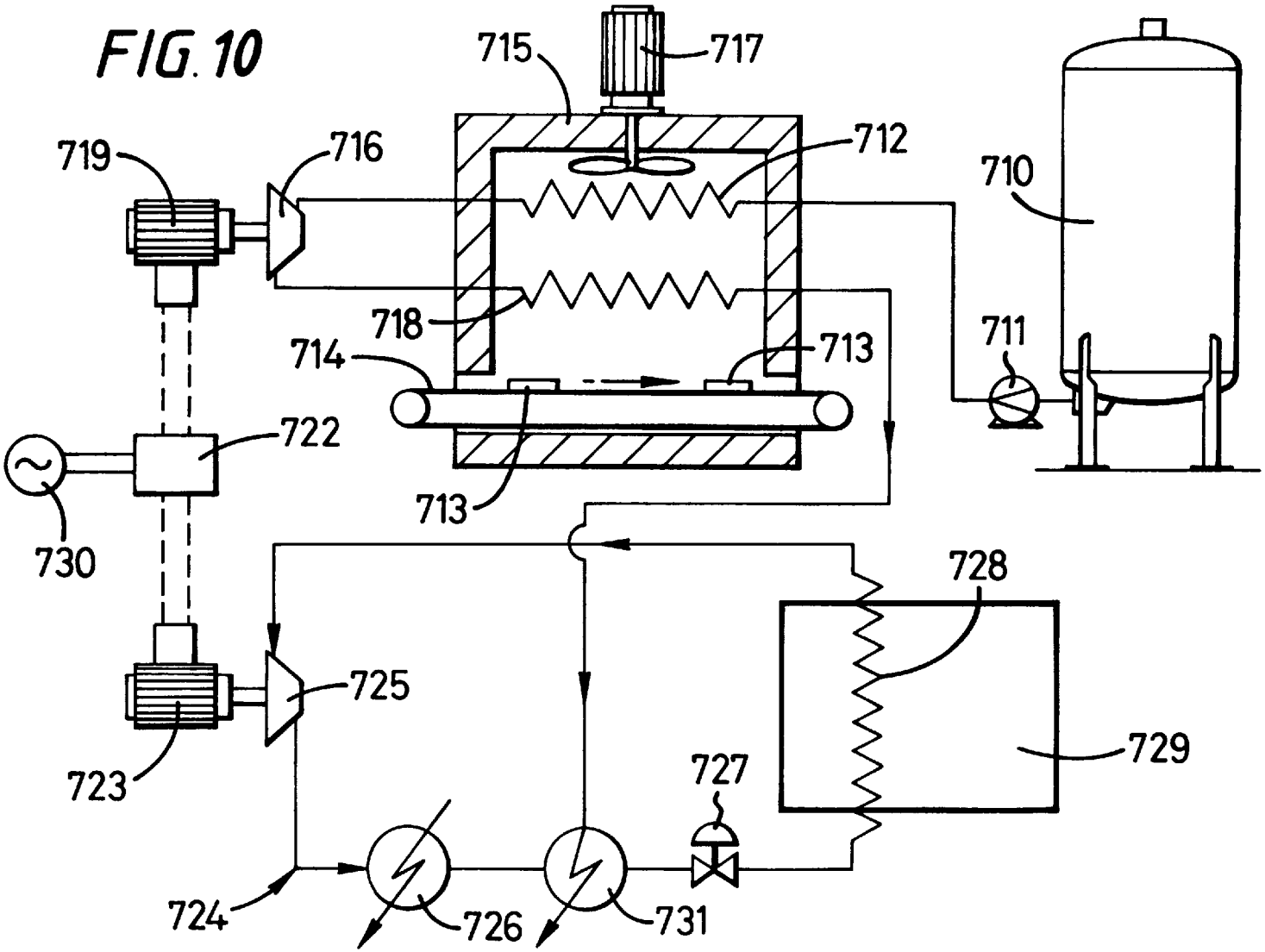
FIG. 10 is a schematic side elevation, partly in cross-section, of an eighth embodiment of an apparatus in accordance with the present invention.

The embodiment shown in FIG. 10 is similar to that shown in FIG. 9 and parts having a similar function have been identified by similar reference numerals in the '700' series. The main difference is that the heat-exchanger 726 has been supplemented by a heat exchanger 731 which is arranged to receive expanded nitrogen vapour leaving the heat exchanger 718, typically at about −40° C.

In use, the cooled refrigerant leaving the heat exchanger 726 is either further cooled and/or partially condensed in the heat exchanger 731 thereby providing further refrigeration for the refrigerated space 729. It is envisaged that the heat exchanger 726 may be omitted in certain embodiments.

If desired the work expander 616;716 could be directly mechanically coupled to the compressor 625;725 with provision being made to drive the compressor 625;725 by mains power 630;730 if and when required.

The refrigerated space 629;729 may be separate and distinct from the freezing tunnel 615;715. However, it is preferably arranged either immediately upstream or immediately downstream thereof according to the food being frozen. Indeed, it is envisaged that some freezing tunnels will be provided with a space at either end thereof which can be individually or both refrigerated.

Figure 11:
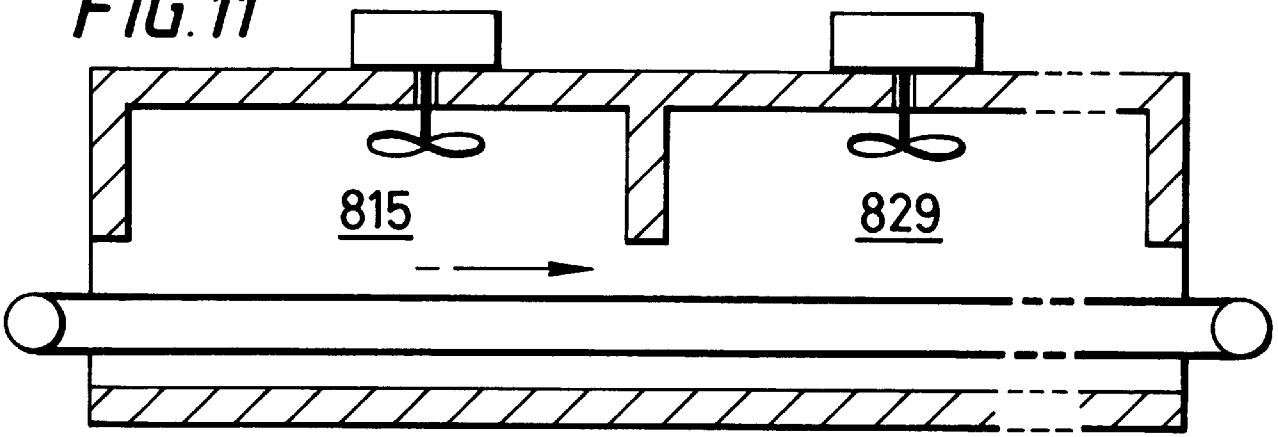
FIG. 11 is a simplified cross-section of a ninth embodiment of an apparatus in accordance with the present invention.

FIG. 11 diagrammatically illustrated a freezing tunnel 815 provided with a refrigerated space 829 downstream thereof. This arrangement is particularly suitable where it is desirable to obtain a frozen crust as quickly as possible and thereafter allow the product to freeze throughout in the refrigerated space. A turbulence inducing fan is provided in the refrigerated space 829 to promote heat transfer to the product being frozen.

Figure 12:
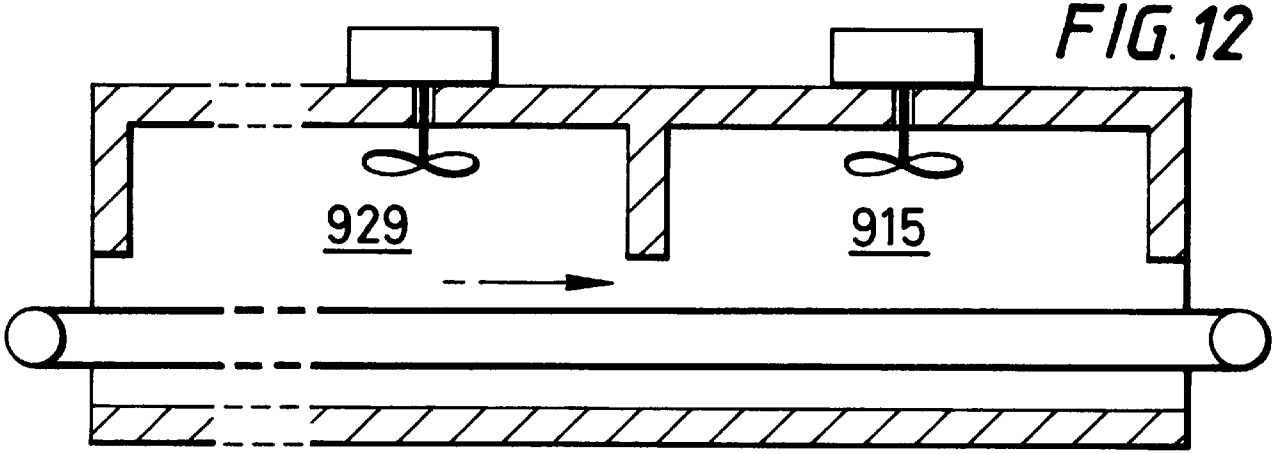
FIG. 12 is a simplified cross-section of a tenth embodiment of an apparatus in accordance with the present invention.

FIG. 12 diagrammatically illustrates a freezing tunnel 915 provided with a refrigerated space 929 upstream thereof. This arrangement is particularly suitable where a relatively slow and relatively inexpensive initial cooldown of the product to just above its freezing point does not cause any significant deterioration to the quality of the frozen product.

Figure 13:
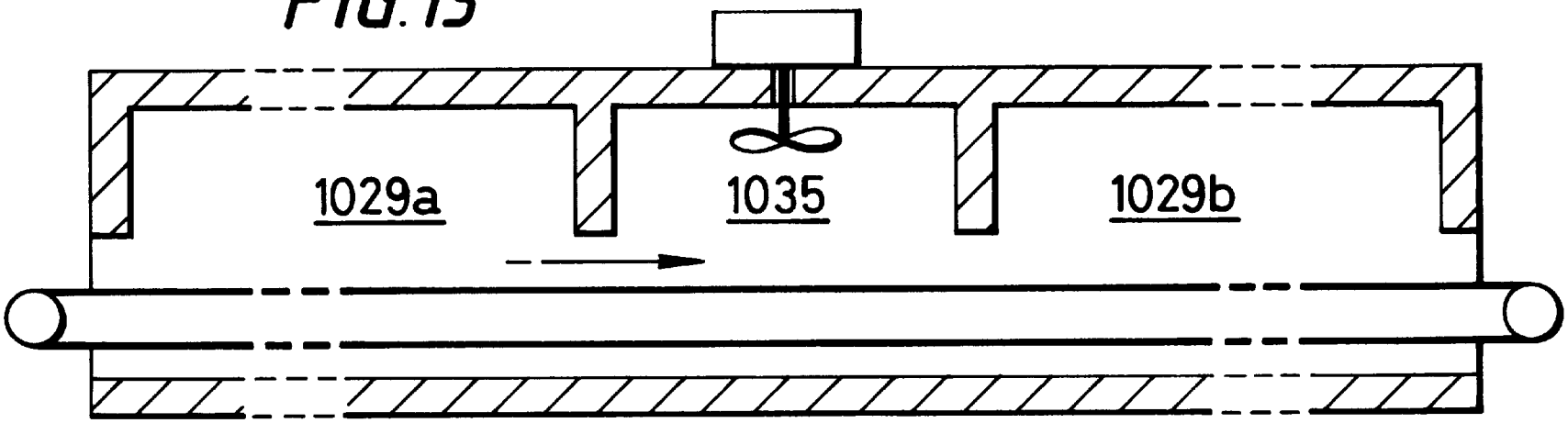
FIG. 13 is a simplified cross-section of an eleventh embodiment of an apparatus in accordance with the present invention.

FIG. 13 diagrammatically illustrates a freezing tunnel 1035 provided with two refrigerated spaces 1029*a* and 1029*b* situated upstream and downstream of the freezing tunnel 1035 respectively. This arrangement is particularly suitable where a relatively slow cool down to just above freezing followed by a quick crust freeze and a equilibration period is acceptable.

In order to maintain high standards of hygiene many tunnel freezers are stopped and steam cleaned at frequent intervals, for example every 24 hours for a single product freezer, or every 6 or 7 hours when freezing small runs of gourmet products. Before the freezing tunnel can be reused it must be cooled down. This is conventionally effected by introducing liquid nitrogen into the freezing tunnel until the desired temperature is reached. It will be appreciated that whilst the use of liquid nitrogen for initial cooldown is very quick it is also very expensive. Significant cost savings can be made by using external electrical power to mechanically cool the refrigerated spaces and drawing the cold air therefrom through the freezing tunnel to achieve part of the initial cooldown.

As indicated previously, liquid air may be used as the cryogenic liquid and, if so used, may usefully be pumped to the pressures indicated for liquid nitrogen.

What is claimed is:

1. An apparatus for freezing a product, which apparatus comprises a freezer, a first heat exchanger in said freezer, a work expander, and a second heat exchanger, the arrangement being such that, in use, a cryogenic liquid can be vaporised and warmed in said heat exchanger, the vapour thus formed expanded in said work expander, and then passed through said second heat exchanger to further refrigerate product in said freezer.

2. An apparatus as claimed in claim 1, including a mechanical refrigerator having a compressor associated therewith, and means for, in use, transferring energy from said work expander to said compressor.

3. An apparatus as claimed in claim 2, wherein said work expander is connected to a generator, said compressor is connected to a motor and said generator is connected to said motor.

4. An apparatus as claimed in claim 3, including a power control unit, wherein said generator is connected to said motor via said power control unit.

5. An apparatus as claimed in claim 4, wherein said power control unit is connectable to mains power and is capable, in use, of directing energy from said mains power to said motor as required.

6. An apparatus as claimed in claim 5, wherein said mechanical refrigerator includes a heat exchanger arranged to cool compressed refrigerant from said compressor in heat exchange with expanded vapour from said freezer.

7. An apparatus as claimed in claim 6, wherein said mechanical refrigerator comprises a refrigerated space disposed downstream of said freezer.

8. An apparatus as claimed in claim 7, further comprising a pump to raise the pressure of the cryogenic liquid prior to entering said heat exchanger.

9. An apparatus as claimed in claim 8, wherein said pump is capable of delivering liquid nitrogen at a pressure of at least 10 bar g.

10. An apparatus for freezing a product, which apparatus comprises a freezer, means for raising the pressure of a cryogenic liquid selected from the group consisting of liquid nitrogen and liquid air substantially inenthalpically to a pressure of at least 10 bar g, a heat exchanger in said freezer in which said cryogenic liquid can be evaporated and warmed to form a vapor, a work expander connected to said heat exchanger and operable to allow the work expansion of vapor from said work expander, and means to bring cold expanded vapor from said work expander into heat exchange with product inside said freezer.

11. An apparatus as claimed in claim 10, wherein said means for raising the pressure of said cryogenic liquid comprises a pump.

12. An apparatus as claimed in claim 10, wherein said means to bring expanded vapour from said work expander into heat exchange with product inside said freezer comprises a pipe for introducing said vapour into the inside of said freezer in direct heat exchange with said product.

13. An apparatus as claimed in claim 10, wherein said means to bring expanded vapour from said work expander into heat exchange with product inside said free comprises a second heat exchanger for conveying expanded vapour from said work expander through said freezer in indirect heat exchange with said product.

14. An apparatus as claimed in claim 10, including means to transfer energy from said work expander to water.

15. An apparatus as claimed in claim 10, wherein said work expander is connected to a fan for inducing turbulence in said freezer.

16. An apparatus as claimed in claim 10, including a mechanical refrigerator having a compressor associated therewith, and means for, in use, transferring energy from said work expander to said compressor.

17. An apparatus as claimed in claim 16, wherein said work expander is directly coupled to said compressor.

18. An apparatus as claimed in claim 17, wherein said work expander is connected to a generator, said compressor is connected to a motor, and said generator is connected to said motor.

19. An apparatus as claimed in claim 18, including a power control unit, wherein said generator is connected to said motor via said power control unit.

20. An apparatus as claimed in claim 19, wherein said power control unit is connectable to mains power and is capable, in use, of directing energy from said mains power to said motor as required.

21. An apparatus as claimed in claim 20, wherein said mechanical refrigerator includes a heat exchanger arranged to cool compressed refrigerant from said compressor in heat exchange with expanded vapour from said freezer.

22. An apparatus as claimed in claim 21, wherein said mechanical refrigerator comprises a refrigerated space.

23. An apparatus as claimed in claim 22, wherein said refrigerated space is disposed downstream of said freezer.

24. An apparatus as claimed in claim 23, wherein said refrigerated space is upstream of said freezer.

25. An apparatus as claimed in claim 24, including two refrigerated spaces one of which is disposed upstream of said freezer and the other of which is disposed downstream thereof.

26. A method of freezing a product, which method comprises the steps of raising the pressure of a cryogenic liquid selected from the group consisting of liquid nitrogen and liquid air substantially isenthalpically to a pressure of at least 10 bar g, introducing said cryogenic liquid into a freezer, vaporising said cryogenic liquid in heat exchange with the product to be frozen and warming the vapour thus formed in indirect heat exchange with said product, work expanding the warmed vapour, and using the work expanded vapour thus obtained to refrigerate product in said freezer.

27. A method according to claim 26, including the step of using a pump to raise the pressure of said cryogen liquid substantially isenthalpically.

28. A method according to claim 26, including the step of bringing the work expanded vapour into direct heat exchange with said product to refrigerate the same.

29. A method according to claim 26, including the step of bringing the work expanded vapour into indirect heat exchange with said product to refrigerate the same.

30. A method according to claim 26, including the step of using the work recovered during said work expansion to heat water.

31. A method according to claim 26, including the step of using the work recovered during said work expansion to drive a turbulence inducing fan.

32. A method according to claim 26, including the step of using at least part of the work recovered during said work expansion to at least partially power a mechanical refrigerator having a refrigerated space.

33. A method according to claim 32, including the step of passing said product through said refrigerated space after freezing it with cryogenic fluid.

34. A method according to claim 32, including the step of passing said product through said refrigerated space before freezing it with cryogenic fluid.

35. A method according to claim 26, wherein said method includes the step of supplying said liquid nitrogen at a pressure of greater than 15 bar g.

36. A method according to claim 35, wherein said method includes the step of supplying said liquid nitrogen at a pressure of less than 20 bar g.

37. A method according to claim 26, wherein said product is a foodstuff.

* * * * *

UNITED STATES PATENT AND TRADEMARK OFFICE

CERTIFICATE OF CORRECTION

PATENT NO. : 6,349,547 B1 
DATED : February 26, 2002
INVENTOR(S) : Jeremy Paul Miller et al.

It is certified that error appears in the above-identified patent and that said Letters Patent is hereby corrected as shown below:

Column 7,
Line 49, cancel "inenthalpically" and insert -- isenthalpically -- to a.

Signed and Sealed this

Fourth Day of June, 2002

*Attest:*

*Attesting Officer*

JAMES E. ROGAN
*Director of the United States Patent and Trademark Office*